US009408442B1

(12) United States Patent
Terry et al.

(10) Patent No.: US 9,408,442 B1
(45) Date of Patent: Aug. 9, 2016

(54) NECKLACE OR BRACELET WITH INTERCHANGEABLE LETTERS AND REMOVABLE LETTER ATTACHMENT COMPONENTS

(71) Applicants: Cathy Diane Terry, Omaha, NE (US); John Malcolm Stewart, Omaha, NE (US)

(72) Inventors: Cathy Diane Terry, Omaha, NE (US); John Malcolm Stewart, Omaha, NE (US)

( * ) Notice: Subject to any disclaimer, the term of this patent is extended or adjusted under 35 U.S.C. 154(b) by 0 days.

(21) Appl. No.: 14/483,892

(22) Filed: Sep. 11, 2014

Related U.S. Application Data

(60) Provisional application No. 61/960,459, filed on Sep. 19, 2013.

(51) Int. Cl.

| | |
|---|---|
| ***A44C 13/00*** | (2006.01) |
| ***A44C 25/00*** | (2006.01) |
| ***A44C 5/20*** | (2006.01) |
| ***A44C 15/00*** | (2006.01) |

(52) U.S. Cl.
CPC ..... *A44C 25/007* (2013.01); *A44C 5/2019* (2013.01); *A44C 15/005* (2013.01)

(58) Field of Classification Search
None
See application file for complete search history.

(56) References Cited

U.S. PATENT DOCUMENTS

D263,288 S * 3/1982 Errigo ..... D11/8

FOREIGN PATENT DOCUMENTS

GB 511023 A * 8/1939 ..... A44B 15/005

* cited by examiner

*Primary Examiner* — Jack W Lavinder

(57) ABSTRACT

A necklace or bracelet assembly comprising regularly spaced letter attachment components, decorative letters and spacers attached to a flexible member. The spacers are for the purpose of maintaining regular separation of the letter attachment components. The letter attachment components are for the attachment of regularly spaced decorative letters to the assembly. The attachment methods used for the letter attachment components and the decorative letters to the assembly will be made with tight, near zero tolerances, thereby preventing the letter attachment components and decorative letters from twisting, sagging, or overlapping. This tight fitting assembly will maintain regular spacing of all letter attachment components and decorative letters allowing the letters selected by the user to remain flat, permanently spaced, comfortable, and easy to read when worn.

5 Claims, 4 Drawing Sheets

NECKLACE OR BRACELET WITH INTERCHANGEABLE LETTERS AND REMOVABLE LETTER ATTACHMENT COMPONENTS

FIELD OF INVENTION

The invention concerns a necklace or a bracelet with regularly spaced components on a flexible connecting member. These components are for the purpose of attaching interchangeable regularly spaced letters to the necklace or bracelet. These interchangeable letters can then spell out any words or names the user wishes to express without these letters twisting, sagging or overlapping.

BACKGROUND OF THE INVENTION

Various devices, particularly in the charm bracelet and charm necklace making field, allow a set of decorative elements to form an individual's desired design of self expression. These devises are usually composed of chains and loose fitting decorative elements attached with hooks, claws, chains, or wires. Because of this type of assembly the decorative elements are very loose, floppy and difficult to view or examine. Therefore, their meaning is lost to the viewers and admirers. This arrangement results in unevenly distributed spaces and elements and often unattractive assemblies when the necklace or bracelet is worn by the user.

It is indispensable for the decorative attachment components and letters of expression to be held on the flexible connecting member at continuous equal spacing. The words and names of self expression selected by those wearing the assemblies can then be easily read and examined by those admiring the jewelry. For example, the users may want to honor their children or grandchildren, favorite performers, schools and mascots, family surnames, or a favorite product line by putting their names on the necklace or bracelet assembly which can be easily read by others.

A first problem to overcome thus consists of arranging components and letters along a necklace or bracelet in a discontinuous manner while keeping these components and letters in predefined positions. This placement must be accomplished without the components or letters twisting, overlapping, or sagging, thereby, maintaining readability.

The second problem consists in making an assembly whose individual components and letters can be easily arranged, removed, and reinstalled while insuring that said components and letters are immobilized in their allocated positions. This is especially important since while the flexible members, components, and letters can be mass produced the final assembly is often performed by hand.

A third problem is linked to the ability of the user of the assembly to easily install, remove, and reinstall the components and letters at their will. By having this freedom of self expression the user can create any variety of appearances from the same total assembly. For example, the necklace or bracelet can be worn with all the components and with letters attached to all the components or the assembly can be changed and worn with a few letters attached to the components or worn with no letters but only components or all letters and components could be removed and only the flexible member worn. This provides the greatest flexibility for the user to create a wide variety of appearances within the same assembly.

A fourth, economical, problem is raised in regard to mass production of the necklaces and bracelets embodied in the invention. The ability to produce technically simple components, letters, flexible members and therefore the entire assembly for the lowest cost is a deciding factor.

Said decorative parts, flexible members, and the total assembly must also answer the necessary criteria of solidity and durability during extended use of the necklace and bracelet.

SUMMARY OF THE INVENTION

This invention pertains to a jewelry assembly formed by a flexible wire necklace or bracelet with removable decorative components for the purpose of attaching interchangeable decorative letters. The letter attaching components will be spring clip attached to the wire necklace or bracelet. These spring clips will attach with near zero tolerances, thereby, preventing twisting or sagging of the components when worn. These components will be maintained at equal spacing on the flexible wire member by permanent jewelry elements and/or spacers. The decorative letters will then be spring clip attached to the components. These spring clip attachments will also have near zero tolerances, thereby, preventing twisting, sagging, or overlapping of the letters. Due to the tight spring clip connections the letters will maintain equal spacing as do the components. This will allow the letters selected by the user to be flat, equally spaced, comfortable and easy to read when worn.

BRIEF DESCRIPTION OF THE DRAWINGS

Note: FIG. 2 is depicted as Cross Section A-A on FIG. 1.

FIG. 5 also shows the interchangeable decorative letter attachment position.

DETAILED DESCRIPTION OF THE INVENTION

Figure 1:
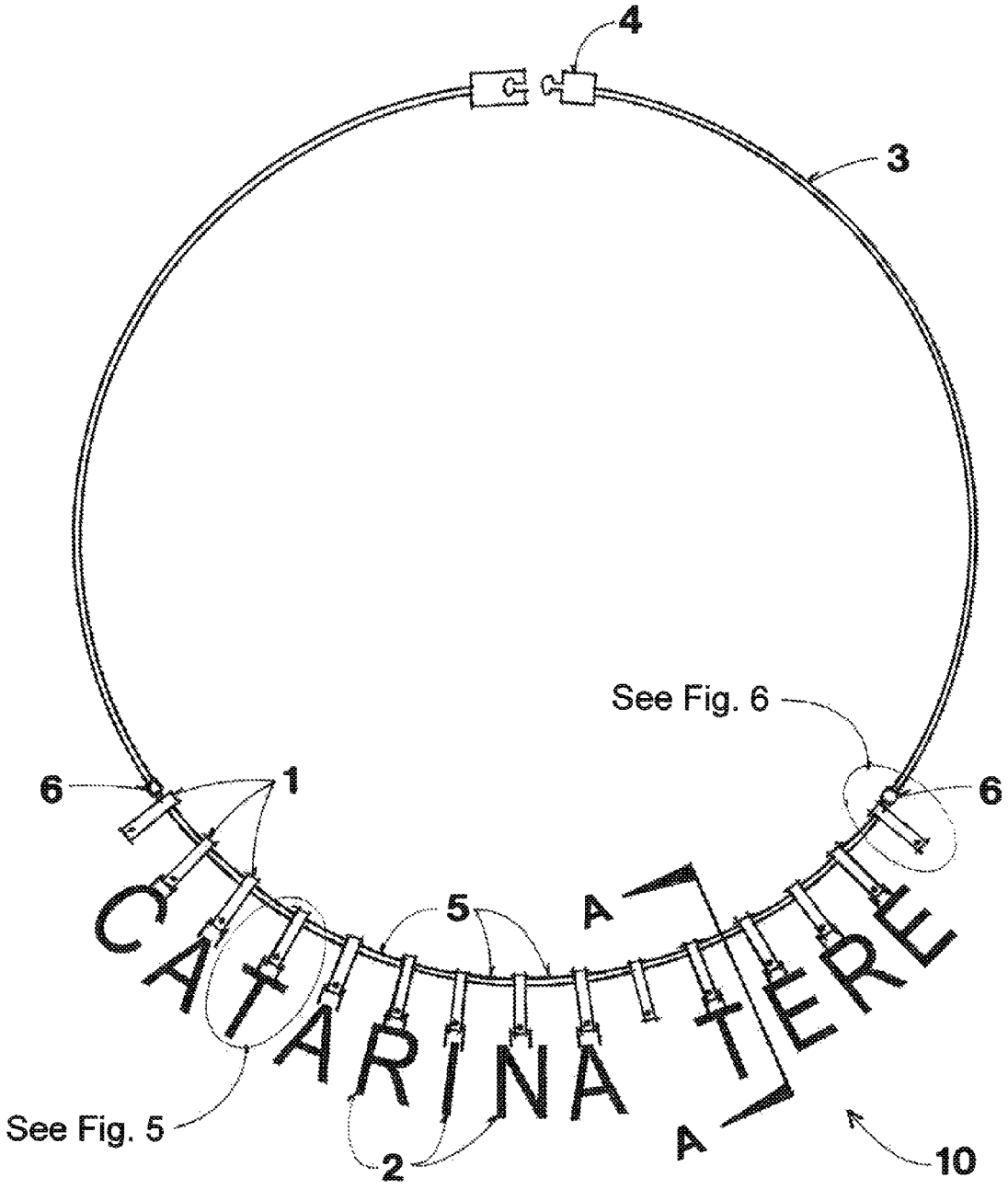
FIG. 1 is an overall front view of a necklace according to the invention.

FIG. 1 shows a necklace 10 comprising removable letter attachment components 1 and interchangeable decorative letters 2 arranged on a flexible connecting member 3, closed with a clasp 4. The removable letter attachment components 1 are held in position, equal distance apart, on the flexible connecting member 3 by spacers 5 slipped over or wrapped around the flexible connecting member 3 except at each end of the row of removable letter attachment components 1 where they are held in position by a fixed jewelry element 6.

While the preferred article of jewelry is a necklace 10 the invention can be adapted for a variety of jewelry pieces, such as a bracelet, a placard, or a pendent.

In this description, a "flexible connecting member" means any connecting member able to bear a certain curvature to form, without breaking, a necklace or a bracelet comprising a clasp 4.

The interchangeable decorative letters 2 can be made of different materials and adorned or not with stones, jewels, or crystals 20. As shown in FIG. 1 the interchangeable decorative letters can be a smooth uniform design and color. As shown in FIGS. 2, 3, 4, 5, and 6 the letters and attachment components can be decorated with a variety of stones, jewels, and crystals 20 in various positions and quantities. The examples of adornments are shown with dotted lines and are not considered parts of this invention.

Figure 2:
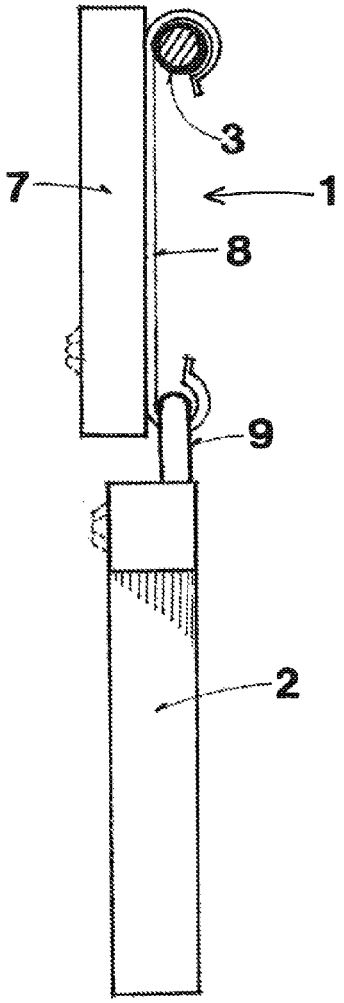
FIG. 2 is a cross section of the necklace showing a side view of a removable letter attachment component and an interchangeable decorative letter and a spring clip as part of the removable letter attachment component.
Figure 3:
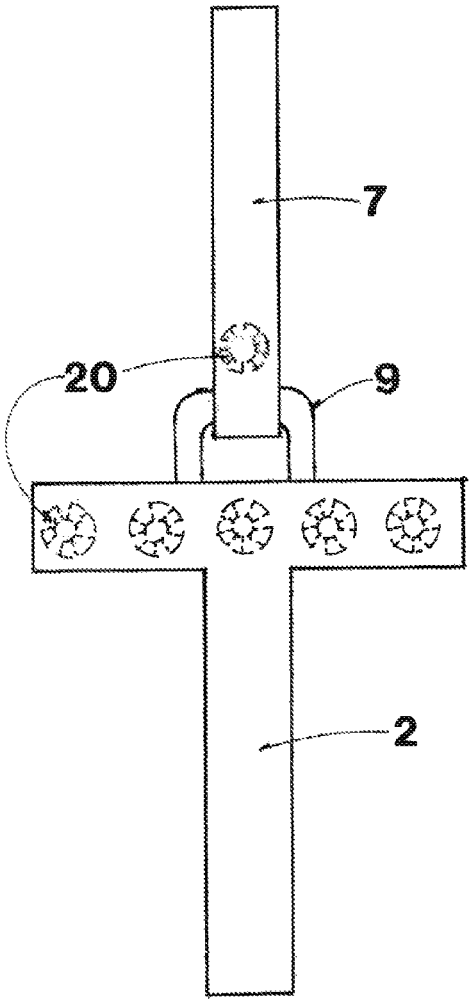
FIG. 3 is a front view of a removable letter attachment component and an interchangeable decorative letter.
Figure 5:
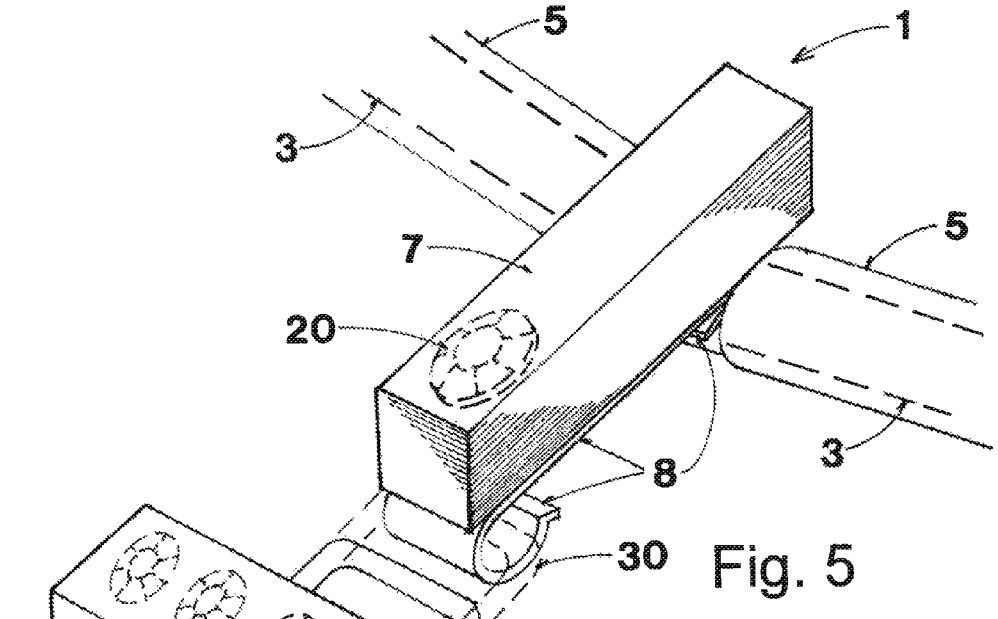
FIG. 5 is a perspective view of a removable letter attachment component spring clip attached to a flexible connecting member and held in position by spacers.

In FIG. 1 the words "CATARINA TERE" are for demonstration purposes only and are not part of this invention. The letter "T" used in FIGS. 2, 3, and 5 is used as an example of the interchangeable letters 2. All letters of the alphabet will be produced and considered part of this invention. These letters will enable the user to convey the words they wish on the necklace or bracelet.

FIG. 2 is a cross section view (A-A) of the flexible connecting member 3 showing a side view of the removable letter attachment component 1 and a side view of an interchangeable decorative letter 2. The removable letter attachment component 1 is comprised of two parts, the decorative jewelry element 7 and a flat spring clip 8. The flat spring clip 8 is permanently attached to the decorative jewelry element 7 and is used to attach the removable letter attachment component 1 to the flexible connecting member 3 and the interchangeable decorative letters 2 to the removable letter attachment component 1. The interchangeable decorative letters 2 all have a nonflexible wire connector 9 for attachment to the flat spring clip 8. These nonflexible wire connectors 9 will be of different sizes and shapes to accommodate the different letters of the alphabet. The nonflexible wire connectors 9 will also be designed so that the interchangeable decorative letters 2 will be centered on the removable letter attachment components 1 when attached.

FIG. 3 is a front view of the decorative jewelry element 7 of a removable letter attachment component 1 and an interchangeable decorative letter 2. The interchangeable decorative letter 2 is attached to the removable letter attachment component 1 by a nonflexible wire connector 9.

Figure 4:
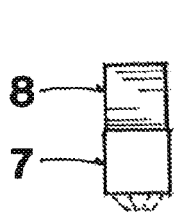
FIG. 4 is a top view of a removable letter attachment component and spring clip.

FIG. 4 is a top plan view of the decorative jewelry element 7 and flat spring clip 8 of a removable letter attachment component 1. Note that the decorative jewelry element 7 and the flat spring clip 8 are the same width. This flat spring clip 8 width will prevent the removable letter attachment component 1 and the interchangeable decorative letters 2 from twisting and sagging when the flat spring clip 8 connections to the flexible connecting member 3 and the nonflexible wire connector 9 are made with near zero tolerances.

Figure 6:
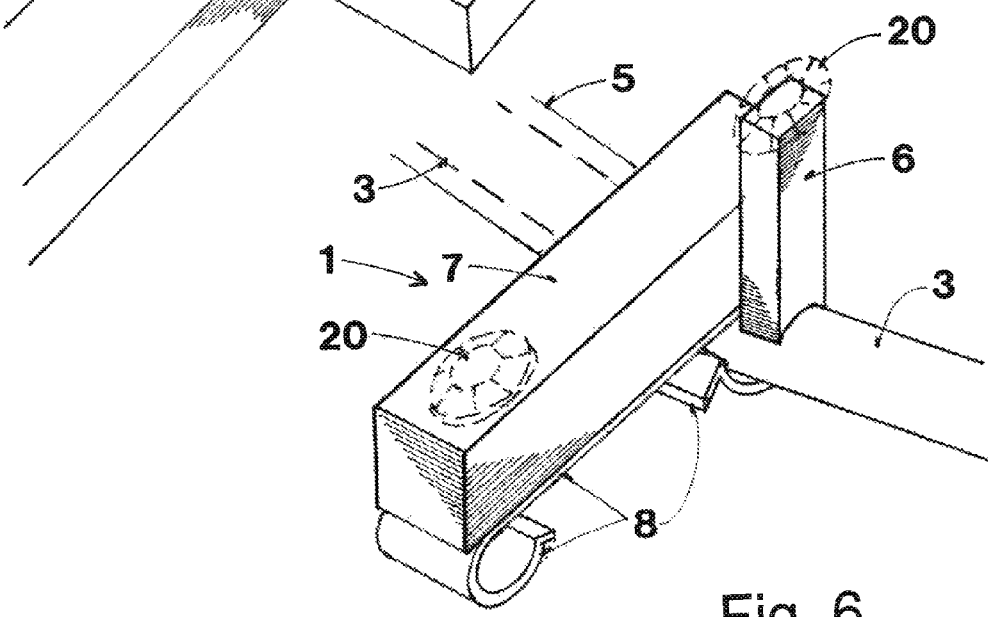
FIG. 6 is a perspective view of a removable letter attachment component spring clip attached to a flexible connecting member and held in position by a fixed jewelry element.

It is critical to the invention that the connections of the removable letter attachment component 1 to the flexible connecting member 3 and the interchangeable decorative letters 2 to the removable letter attachment components 1 be tight and without lateral movement. FIG. 5 and FIG. 6 are perspectives showing the connections and the relationships of the invention components.

FIG. 5 shows the removable letter attachment component 1 flat spring clip 8 attached to the flexible connecting member 3 and held in position by spacers 5. These spacers 5 are slipped over or wrapped around the flexible connecting member 3. The spacers 5 will be of equal length to provide equal spacing for the removable letter attachment components 1 and, therefore, equal spacing of the interchangeable decorative letters 2. The spacers 5 are also larger in diameter than the openings in the flat spring clips 8 to prevent the removable letter attachment component 1 from sliding out of their desired positions. The spacers 5 used in this invention are not limited to the examples illustrated. Such jewelry elements as slip on crystals, disks, rings, and beads slipped over the flexible connecting member 3 could also be used for their various decorative values.

FIG. 5 also illustrates the attachment relationship of an interchangeable decorative letter 2 and the nonflexible wire connector 9 to the flat spring clip 8. This attachment relationship is indicated by the dotted line 30.

FIG. 6 also shows the removable letter attachment component 1 attached to the flexible connecting member 3 but at the end of the row of these components. In this example the removable letter attachment component 1 is held in position by a spacer 5 on one side and a fixed jewelry element 6 permanently attached to the flexible connecting member 3 on the other. This permanent attachment prevents the entire row of removable letter attachment components 1 from sliding or shifting positions on the flexible connecting member 3. Note that these permanently attached jewelry elements 6 could also be used to hold any or all removable letter attachment components 1 in their desired positions and not just at the ends of the row of components as illustrated in this example. Further, in this drawing a jewelry post is shown with the ability to mount a crystal, jewel, or stone 20 to its top. However, other jewelry elements such as slip on crystals, disks, rings, or beads could also be used as permanently attached fixed jewelry elements 6.

Figure 7:
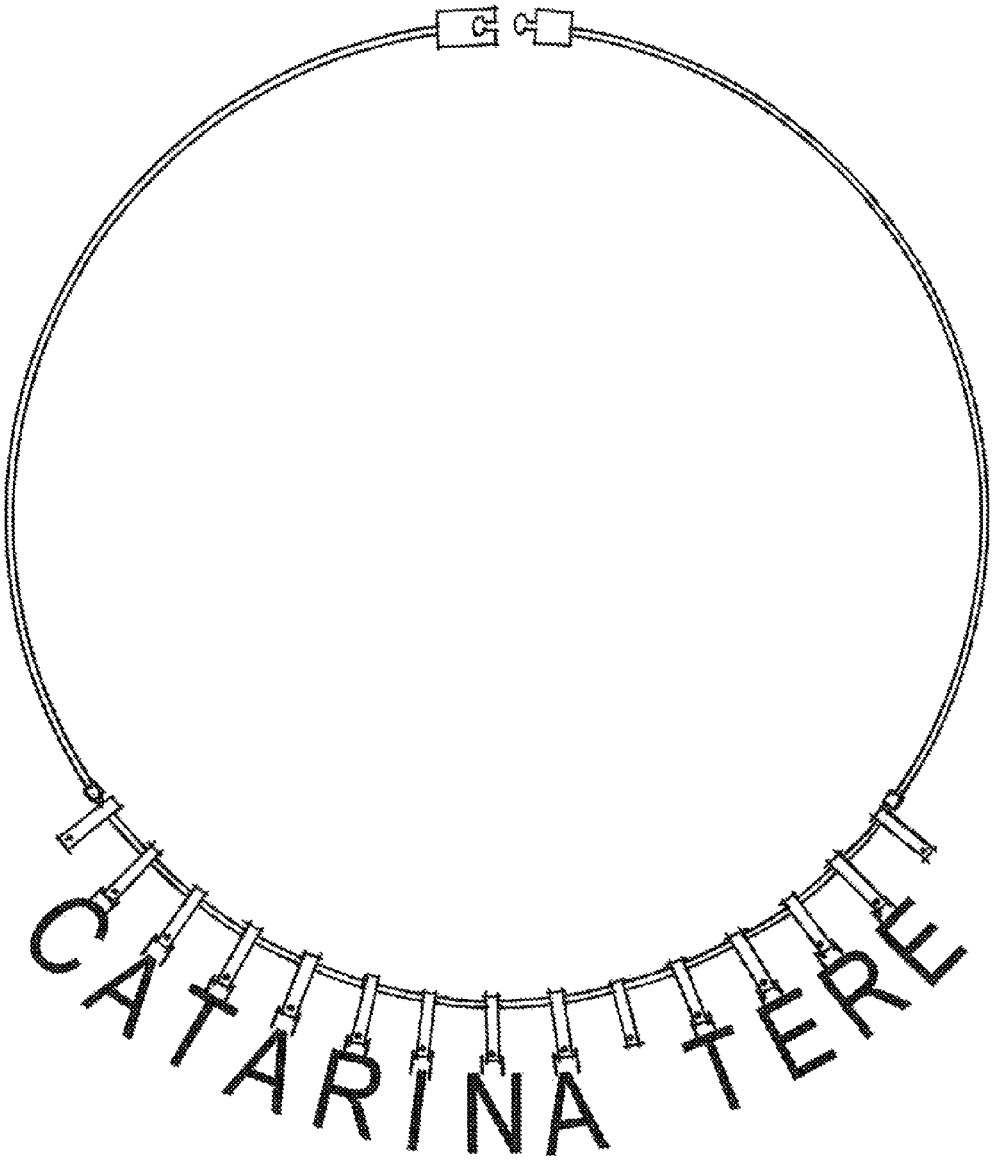
FIG. 7 is a front view of an example necklace according to the invention.

FIG. 7 is a front view of an example necklace of the invention.

Of course, the invention is not limited to the embodiment described and shown by way of example, but it also includes all technical equivalents and combinations thereof.

What is claimed is:

1. A necklace or bracelet comprising: a flexible connecting member closed with a clasp or hook and with slip-on or wrap around spacers to maintain an equal distance between each removable letter attachment component; regularly spaced removable letter attachment components with a flat spring clip at each end that are configured to be attached to the flexible connecting member with near zero tolerance with either one of said flat spring clips, thereby, preventing twisting, sagging, and overlapping of said removable letter attachment components when attached to said flexible connecting member; and a plurality of decorative interchangeable letters attachable to said removable letter attachment components with near zero tolerance by the other one of said flat spring clips; thereby, preventing said letters from twisting, sagging, and overlapping when a plurality of said decorative interchangeable letters are attached to the necklace or bracelet so that they will remain equally spaced and easily readable by the viewer.

2. The necklace or bracelet in claim 1 wherein said flexible connecting member can be a wire, chain or a combination thereof.

3. The necklace or bracelet in claim 1 wherein said spacers are slip on crystals, disks, rings, or beads.

4. The necklace or bracelet in claim 1 wherein said letter attachment component can be plain, etched, or adorned with a variety of jewelry elements such as crystals or stones; said flat spring clips and removable letter attachment components shall be of substantially equal width.

5. The necklace or bracelet in claim 1 wherein said decorative interchangeable letters can be made of a variety of materials and can be plain, etched, or adorned with a variety of jewelry elements such as crystals or stones; each of said plurality of decorative interchangeable letters including a wire loop centered at the top thereof for connection to said other one of said flat spring clips; each said wire loop having a horizontal top portion providing a secure fit with said other one of said flat spring clips; thereby, preventing said decorative interchangeable letters from twisting, sagging, and overlapping but allowing said plurality of decorative interchangeable letters to swing from front to rear of the necklace or bracelet allowing comfortable conformance to the natural contours of the wearer.

* * * * *